United States Patent [19]

Holloway

[11] 4,428,490

[45] Jan. 31, 1984

[54] DRINKING VESSEL WITH INTEGRAL STRAW

[76] Inventor: Richard D. Holloway, 2 Chepstow Villas, London, W.11, England

[21] Appl. No.: 426,865

[22] Filed: Sep. 29, 1982

[30] Foreign Application Priority Data

Oct. 15, 1981 [GB] United Kingdom ..... 8131111

[51] Int. Cl.[3] ..... A47G 19/22

[52] U.S. Cl. ..... 215/1 A; 215/99.5; 220/90.2

[58] Field of Search ..... 215/1 R, 1 A, 99.5, 215/100 R, 229; 220/90.2; D7/6, 11, 13, 42

[56] References Cited

U.S. PATENT DOCUMENTS

| | | | |
|---|---|---|---|
| 162,640 | 4/1875 | Fowler | 215/99.5 |
| D. 186,535 | 11/1959 | Saffer | 215/1 A X |
| 231,747 | 8/1880 | Arnold | 215/1 R |
| 1,030,859 | 7/1912 | Anagnostou | 215/1 R X |
| 1,997,914 | 4/1935 | Pollard | 215/1 A |
| 2,432,132 | 12/1947 | Allen | 215/1 A |
| 3,606,156 | 9/1971 | Homorodean, Jr. et al. | 215/1 A X |
| 3,921,889 | 11/1945 | Gibbons | 229/7 S |
| 4,016,998 | 4/1977 | Finch | 215/1 A X |
| 4,033,453 | 7/1977 | Giaimo | 215/1 A X |
| 4,191,302 | 3/1980 | Fiducia | 215/1 A X |

FOREIGN PATENT DOCUMENTS

| | | |
|---|---|---|
| 239794 | 9/1925 | United Kingdom . |
| 598612 | 2/1948 | United Kingdom . |
| 766938 | 1/1957 | United Kingdom . |
| 972363 | 10/1964 | United Kingdom . |

*Primary Examiner*—William Price
*Assistant Examiner*—Sue A. Weaver
*Attorney, Agent, or Firm*—Romney, Golant, Martin, Disner & Ashen

[57] ABSTRACT

This invention relates to drinking vessels, such as cups, mugs, beakers, tumblers or glasses, whether of glass, plastics or other suitable material. The drinking vessels comprise an integral 'straw' and base in the form of a hollow tube, which may be singly or multiply coiled and which is in liquid flow communication with the 'glass proper', herein termed a reservoir.

Liquid in the reservoir can be sucked in the manner of a drinking straw or in the 'normal' way by drinking from the rim of the reservoir.

27 Claims, 7 Drawing Figures

DRINKING VESSEL WITH INTEGRAL STRAW

This invention relates to drinking vessels, a term which is used herein to include cups, mugs, beakers, tumblers or glasses, whether of glass, plastics or other suitable material.

The invention aims to provide a drinking vessel which, by the incorporation of a tube through which a liquid may be sucked, is likely to appeal as a novelty item while having functional novelty also.

According to one aspect of the invention a drinking vessel comprises a reservoir for holding a liquid, and a tube which communicates with the reservoir and through an open end of which liquid in the reservoir can be sucked in the manner of a drinking straw, a portion of the tube being formed so as to provide a support base of the vessel.

According to another aspect of the invention a drinking vessel comprises a one-piece member of light-transmitting material, said member including:

(a) a main reservoir portion, and (b) a coiled tube portion, said portions being in flow communication with each other via a flow junction, (i) said coiled tube portion including at least one turn having an inside radius which is at least equal to the maximum radial dimension of said junction, (ii) and said coiled tube portion terminating in an open tube end from which liquid may be withdrawn from the vessel by the application of suction, (iii) said open tube end being spaced both radially and axially from the main reservoir portion.

According to a further aspect of the present invention, a drinking vessel comprises a main reservoir portion including a base and a tube portion extending wholly externally of the said reservoir portion, and a junction between the base of said reservoir portion and one end of the said tube portion, the said junction being disposed externally of the said reservoir portion and being open so as to permit beverage flow communication between the said reservoir portion and the said tube portion; and the other end of the said tube portion being also open to permit a user's lips to encompass it and to suck through it.

The tube may lead out of the base of reservoir, so that the latter can be completely drained, or may lead out of the reservoir above the base thereof. Between said portion and said open end, the tube may follow any convenient path, such as extending upwardly in a straight line or in a spiral around the reservoir or bowl of the vessel.

The vessel may be of any suitable material, e.g. rigid or semi-rigid plastics or glass, and is preferably transparent so that the liquid draining from the reservoir and passing along the tube can be seen as the liquid is drunk from the vessel. The reservoir preferably has an open upper end with a rim over which the liquid can be drunk as an alternative to sucking through the 'straw' provided by the tube.

Preferred embodiments of the invention will now be described, purely by way of example, with reference to the accompanying drawings, wherein.

Figure 1:
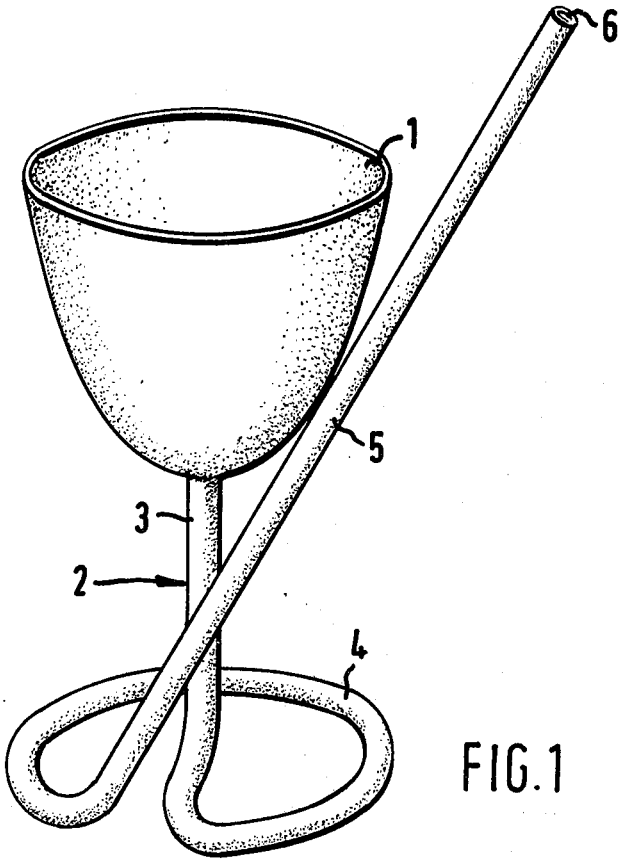
FIG. 1 is a perspective view of a cocktail or 'martini' glass according to the invention.

FIG. 1 shows a drinking vessel in the general shape of a cocktail glass, the vessel having a bowl or reservoir 1 which tapers downwardly to one end of a tube 2 communicating with the reservoir. The tube 2 has a vertical portion 3 serving as a stem for the glass, going over into a horizontally disposed loop 4 forming a base support for the glass. From the loop 4, the tube 2 goes over into an upwardly extending portion 5 running beside the adjacent outer wall of the reservoir 1, to an open end 6.

Figure 2:
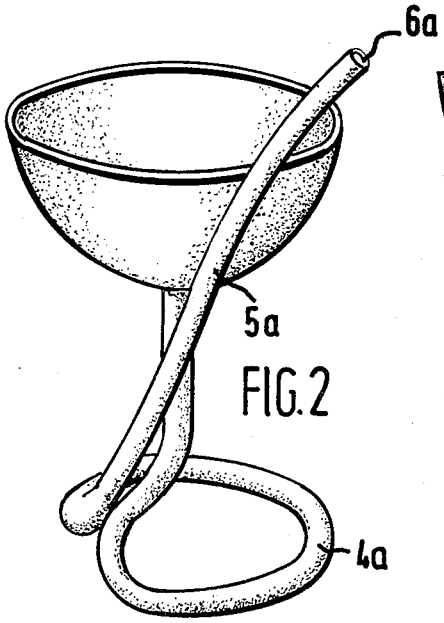
FIGS. 2 and 3 show, respectively in perspective and side elevation, a second embodiment of a cocktail glass according to the invention.
Figure 3:
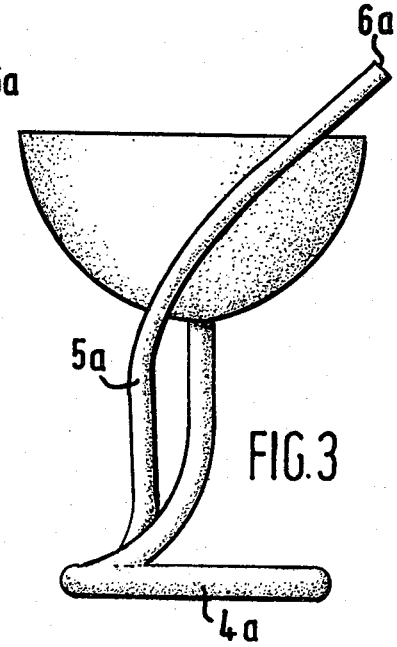

FIGS. 2 and 3 are views of a further embodiment of drinking vessel which are generally similar to that of FIG. 1 except that the tube is shaped differently over its length 5*a* between the base loop 4*a* and the open end 6*a*.

Figure 4:
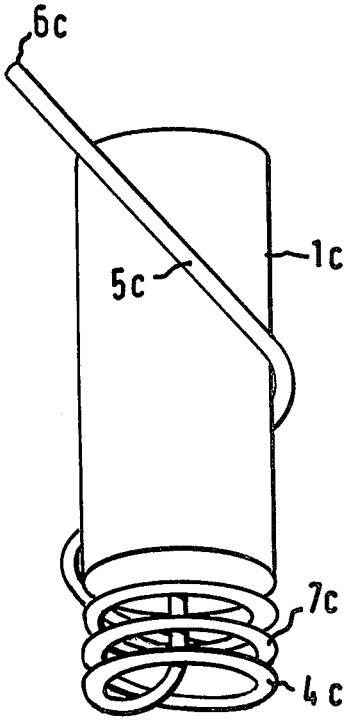
FIGS. 4 and 5 show, respectively in perspective a side elevation, a first embodiment of a tumbler according to the invention.
Figure 5:
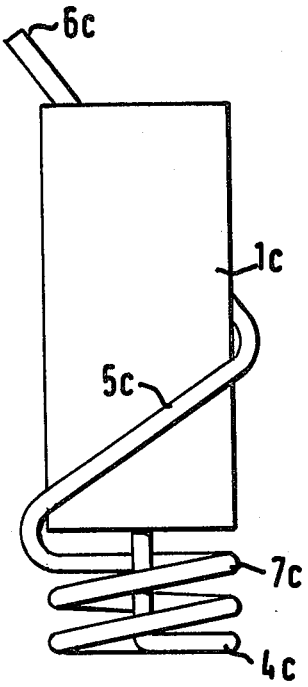

In FIGS. 4 and 5 the vessel is in the form of a tumbler. It has a cylindrical bowl or reservoir 1*c* from the base of which extends a vertically extending tubular stem in flow communication with a base-forming loop 4*c*. The loop 4*c* goes over into further loops of a spiral 7*c* between the base loop 4*c* and the underside of the bowl or reservoir 1*c*. The external diameter of the loops 4*c*, 7*c* is similar to that of the bowl or reservoir 1*c*. The tube is curved around the reservoir at 5*c* as it passes upwardly to an open end 6*c*.

Figure 6:
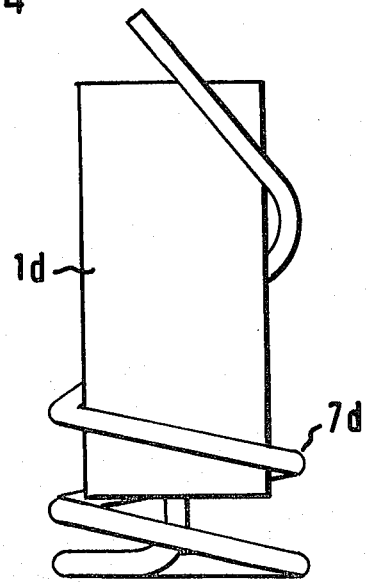
FIG. 6 is a side elevational view of a second embodiment of a tumbler according to the invention.

FIG. 6 is similar to FIGS. 4 and 5 except that all of the bottom turns of the spiral 7*d*, as well as the upper turns of the spiral 7*d* that encircle the reservoir 1*d*, are of internal diameter greater than the external diameter of the reservoir 1*d*.

Figure 7:
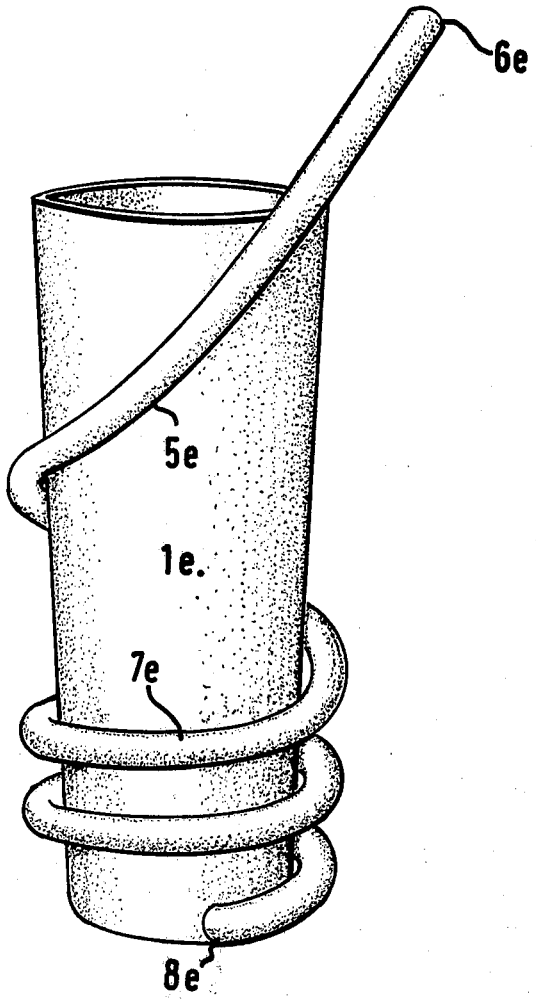
FIG. 7 illustrates a third embodiment of a tumbler according to the invention.

Finally, FIG. 7 illustrates another tumbler having a reservoir 1*e* with a junction 8*e* near its base where a spiral tube joins in flow communication with the interior of the reservoir 1*e*. The tube has a number of rising spiral turns 7*e* around the base portion of the reservoir 1*e* going over into a rising 'straw' portion 5*e* which terminates in a suction opening 6*e*.

In the embodiments of FIGS. 4 to 7 the multi-turn spiral 7*c* or 7*d* or 7*e* provides mechanical protection for the vulnerable junction between the reservoir and the tube.

In all embodiments, the vessel is of transparent or translucent material so that the liquid draining from the reservoir and passing along the tube can be seen as the liquid is drunk from the vessel; a very effective novelty, especially for coloured drinks.

I claim:

1. A one-piece drinking vessel adapted for use as a martini glass at cocktail parties and comprising:

a reservoir for holding liquid, said reservoir having a base region and an upper rim region; and a continuous integral tube one open end of which is permanently and integrally secured in liquid flow communication with the base region of said reservoir while its other open end is disposed above and spaced from said rim region, whereby through said other open end liquid in the reservoir can be sucked in the manner of a drinking straw;

a portion of the tube being shaped to extend downwardly from said base region so as to provide a stable support base of the vessel; and the reservoir being substantially and distinctly larger in capacity than the total capacity of the tube, whereby:

the reservoir portion closely simulates a conventional drinking glass of the martini-glass type, and the downwardly extending portion of the tube simulates the delicate stem and base of such a conventional drinking glass of the martini-glass type; but the above-disposed open end of the tube simulates a conventional drinking straw.

2. A drinking vessel according to claim 1, wherein said portion of the tube includes at least one coiled part of the tube which serves as the said base.

3. A drinking vessel according to claim 1, wherein the tube has a generally vertical length between the reservoir and said portion, this vertical length serving as a stem of the vessel and extending from said base region at the central vertical axis of the vessel.

4. A drinking vessel according to claim 1, wherein between said portion and said other open end, the tube extends in a multi-turn spiral around the outside of the reservoir of the vessel.

5. A drinking vessel according to claim 1, wherein the vessel is of transparent or translucent material, so that the liquid draining from the reservoir and passing along the tube can be seen as the liquid is drunk from the vessel.

6. A drinking vessel comprising a one-piece member of light-transmitting material, said member including:

(a) a main reservoir portion that is generally similar to a conventional drinking glass, being generally in the form of a wide-mouthed unitary open bowl having a very generally vertical centerline;

(b) a coiled tube portion comprising a tube that is coiled about and spaced radially outward from the centerline of the reservoir portion; and (c) a transition portion integrally and permanently secured to the reservoir portion, said reservoir and transition portions being in flow communication with each other via a flow junction, and said transition portion integrally and permanently interconnecting the flow junction with the coiled tube portion, for flow of liquid from the junction to the coiled tube portion along a flow path that is at least in part radially outward relative to the centerline;

(i) said coiled tube portion including at least substantially one turn having an inside radius which is at least as large as the maximum radial dimension of said junction, both the radius of the said one turn and the radial dimension of the junction being measured relative to the centerline of the main reservoir portion, (ii) and said coiled tube portion terminating in an open tube end which is spaced radially outward from and axially above the main reservoir portion, and which is a permanent and integral part of the coiled tube portion and is in fluid communication therewith, from which open tube end liquid may be withdrawn from the vessel by the application of suction.

7. The vessel of claim 6 wherein the said at least substantially one turn is spaced downwardly from the reservoir and forms a support structure therefor.

8. The vessel of claim 7 wherein:

there is only substantially one turn of said coiled tube portion;

the transition portion includes, in conjunction with the at least partly radially outward flow path, a substantially vertical tube portion; and the flow junction is generally central to the bottom of the reservoir.

9. The vessel of claim 6 wherein:

at least substantially one first turn of said coiled tube portion is spaced downwardly from the reservoir portion and forms a support therefor; and at least substantially one-half other turn of said coiled tube portion is disposed around and spaced slightly outward from the exterior of the reservoir portion.

10. The vessel of claim 9, wherein:

the first turn is connected with the flow junction by the said transition portion, and the transition portion includes, in conjunction with the said at least partly radially outward flow path, a substantially vertical tube portion; and the flow junction is generally central to the bottom of the reservoir.

11. The vessel of claim 9 wherein:

said reservoir and said first turn are very generally circular in plan;

said other turn is very generally circular or circle-segmental in plan; and the first turn has radial dimensions, relative to the center of said reservoir, that are significantly smaller than the corresponding radial dimensions of said other turn.

12. The vessel of claim 9 wherein:

said reservoir and said first and second turns are very generally circular in plan; and said first turn has radial dimensions approximately equal to the corresponding radial dimensions of said other turn.

13. The vessel of claim 12, wherein:

the first turn is connected with the flow junction by the said transition portion, and the transition portion includes, in conjunction with the said at least partly radially outward flow path, a substantially vertical tube portion; and the flow junction is generally central to the bottom of the reservoir.

14. The vessel of claim 6 wherein:

the said at least substantially one turn is disposed around and spaced slightly outward from the reservoir.

15. The vessel of claim 14 wherein the flow junction is at the side of the reservoir, adjacent its bottom.

16. The vessel of claim 15 wherein:

the reservoir is generally flat-bottomed; and the turn is connected with the flow junction by a substantially horizontal and very short tube portion which is disposed in a very generally radial orientation relative to the reservoir and generally parallel to the bottom.

17. A one-piece drinking vessel of light-transmitting material comprising:

a wall defining a reservoir having a base region and an upper rim region;

a coiled tube one open end of which is in flow communication through the reservoir wall with the base region of the reservoir and at least substantially one turn of which tube is disposed around the reservoir, the other open end of the tube being disposed above and spaced from said rim portion;

whereby through said other open end of said tube liquid in the reservoir can be sucked in the manner of a drinking straw.

18. The vessel of claim 17, wherein at least substantially one further turn of the coiled tube is spaced downwardly from the reservoir and forms a support structure therefor.

19. The vessel of claim 18, wherein:

the said at least substantially one further turn is connected with the reservoir by a substantially vertical tube portion that is joined to the reservoir wall at a location that is generally central to the bottom of the reservoir.

20. The vessel of claim 18, wherein:

said reservoir and the turn disposed around the reservoir and said further turn are very generally circular in plan; and the said further turn has radial dimensions, relative to the center of the reservoir, that are significantly smaller than the corresponding radial dimensions of the turn disposed around the reservoir.

21. The vessel of claim 20, wherein:

the said further turn is connected with the reservoir by a substantially vertical tube portion that is joined to the reservoir wall at a location that is generally central to the bottom of the reservoir.

22. The vessel of claim 20, wherein said further turn has an outside radius approximately equal to the outside radius of the bottom of the reservoir.

23. The vessel of claim 18, wherein:

said reservoir and the turn disposed around the reservoir and said further turn are very generally circular in plan; and said further turn has radial dimensions approximately equal to the corresponding radial dimensions of said turn disposed around the reservoir.

24. The vessel of claim 15, wherein:

said further turn is connected with the reservoir by a substantially vertical tube portion that is joined to the reservoir wall at a location that is generally central to the bottom of the reservoir.

25. The vessel of claim 17, wherein:

the tube is joined to the reservoir wall at the side of the reservoir, adjacent its bottom.

26. The vessel of claim 25, wherein:

the reservoir wall is generally flat-bottomed; and the turn is connected with the reservoir wall by a substantially horizontal and very short tube portion which is disposed in a very generally radial orientation relative to the reservoir and generally parallel to the bottom.

27. The vessel of claim 17, wherein:

substantially three turns of the coiled tube are disposed around the reservoir.

* * * * *